US009368006B1

(12) United States Patent
Gorilovsky

(10) Patent No.: US 9,368,006 B1
(45) Date of Patent: Jun. 14, 2016

(54) WEARABLE BRACELET WITH BIDIRECTIONAL NETWORK CONNECTIVITY AND TOUCH FEEDBACK

(71) Applicant: Woodenshark LLC, Wilmington, DE (US)

(72) Inventor: Dmitry Gorilovsky, St. Petersburg (RU)

(73) Assignee: Woodenshark, LLC, Wilmington, DE (US)

( * ) Notice: Subject to any disclaimer, the term of this patent is extended or adjusted under 35 U.S.C. 154(b) by 99 days.

(21) Appl. No.: 14/082,150

(22) Filed: Nov. 17, 2013

Related U.S. Application Data

(60) Provisional application No. 61/881,608, filed on Sep. 24, 2013.

(51) Int. Cl.
*G08B 1/08* (2006.01)
*G08B 6/00* (2006.01)

(52) U.S. Cl.
CPC ..... *G08B 6/00* (2013.01)

(58) Field of Classification Search
CPC ..... G08B 6/00
USPC ..... 340/539.11
See application file for complete search history.

(56) References Cited

U.S. PATENT DOCUMENTS 7,920,169 B2 * 4/2011 Jung et al. ..... 348/211.1
8,098,141 B2 * 1/2012 Vanska et al. ..... 340/407.1
8,326,378 B2 * 12/2012 Ungari ..... H04M 1/72547 455/41.2
8,562,489 B2 * 10/2013 Burton ..... G04F 10/00 482/1
8,787,006 B2 * 7/2014 Golko et al. ..... 361/679.03
8,805,646 B2 * 8/2014 Messenger et al. ..... 702/160
8,972,220 B2 * 3/2015 Park et al. ..... 702/160
8,974,349 B2 * 3/2015 Weast et al. ..... 482/8
9,024,749 B2 * 5/2015 Ratajczyk ..... 340/539.11
2010/0123588 A1 * 5/2010 Cruz Hernandez ..... 340/573.1
2010/0210323 A1 * 8/2010 Collins et al. ..... 455/575.1
2010/0268056 A1 * 10/2010 Picard et al. ..... 600/388
2011/0003665 A1 * 1/2011 Burton et al. ..... 482/9
2011/0054359 A1 * 3/2011 Sazonov ..... A43B 3/0005 600/595
2011/0304497 A1 * 12/2011 Molyneux et al. ..... 342/42
2012/0293410 A1 * 11/2012 Bell ..... G06F 3/014 345/158
2013/0127980 A1 * 5/2013 Haddick ..... G06F 3/013 348/14.08
2013/0278552 A1 * 10/2013 Kamin-Lyndgaard . G09G 5/006 345/174
2014/0293755 A1 * 10/2014 Geiser et al. ..... 368/12

* cited by examiner

*Primary Examiner* — Eric M Blount
(74) *Attorney, Agent, or Firm* — Bardmesser Law Group

(57) ABSTRACT

A wearable electronic device includes a wristband; a detachable electronic module adapted to fit into the wristband, the module including a controller, a control button, a tactile sensor, a wireless interface adapter, and a tactile event reproduction element, all connected to the controller. The module is configured to transmit a touch or a tap on the tactile to a second wearable device through the wireless interface adapter, and to receive a notification of a tactile event on the second wearable device through the wireless interface adapter and to reproduce the tactile event using the reproduction element. The tactile sensor can be an accelerometer, a MEMS, a gyroscope, a capacitive sensor or a resistive sensor. The network adapter can be a Bluetooth adapter or ANT+ standard-enabled, and connects to a smartphone or a tablet. The network adapter connects to the second device over the Internet via a server.

18 Claims, 11 Drawing Sheets

WEARABLE BRACELET WITH BIDIRECTIONAL NETWORK CONNECTIVITY AND TOUCH FEEDBACK

CROSS-REFERENCE TO RELATED APPLICATIONS

This application is a non-provisional application of U.S. Provisional Patent Application No. 61/881,608, filed Sep. 24, 2013, entitled WEARABLE BRACELET WITH BIDIRECTIONAL NETWORK CONNECTIVITY AND TOUCH FEEDBACK, incorporated by reference herein in its entirety.

BACKGROUND OF THE INVENTION

1. Field of the Invention

The present invention is related to wearable electronic devices, and more particularly, to a novel wearable electronic device with an interface for transferring information between such devices over networks.

2. Description of the Related Art

U.S. Pat. No. 7,336,260 describes a device for reproducing tactile events, where the device includes a tactile sensor, a mechanical or similar type of a switch, as well as possibly a non-mechanical switch, and a means for generating a feedback for tactile events, including a source of mechanical vibration and a device for electronic control of an interactive reaction to the actions of the user, as well as a generating a necessary response using the tactile feedback element. The primary disadvantage of this device is the inability to send data regarding tactile events to other devices.

U.S. Pat. No. 8,159,461 describes a device for reproducing tactile events, that includes an input device (such as a mechanical element, e.g., a button, a lever, a switch, etc.), as well as a possibly tactile element, such as a touch pad, and a controller connected to these elements, together with a mechanism for reproducing tactile information, such as a vibration motor. The controller can be programmed to reproduce tactile events of different types and to process different types of events. The primary disadvantage of the system described in this publication is the inability to rapidly and automatically transfer tactile information between connected devices, and between various devices of this type.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EMBODIMENTS OF THE INVENTION

Reference will now be made in detail to the embodiments of the present invention, examples of which are illustrated in the accompanying drawings.

The proposed invention is intended to connect people located in different locations, where both people wear the device of the present invention. In essence, the proposed device permit one person, when he wants to let another person know that he is thinking of them, to tap the wearable device, which, for example, may be in the form of a bracelet, as described below, and the other person will sense that fact because his bracelet begins to vibrate, in sync with the first person's touching of the tactile element or sensor on his bracelet. Thus, instead of the more cumbersome mechanism of emailing or texting someone to say "I am thinking of you", or "I love you", the wearer of a bracelet can touch the bracelet, and the other person will "get the message"

To that end, the wearable electronic device, such as a bracelet, includes a tactile sensor connected to a controller, a control button, a wireless module connected to the controller, a battery, a charging interface, and an element for reproducing tactile information (e.g., the vibration motor). The tactile sensor is connected, through the controller and the wireless connection module to a second such device, which is typically worn on a different person's wrist. In a typical case, the connection would be through a Bluetooth or similar module to a smart phone, which in turn connects to a cloud based service or a server, which in turn connects to the second such bracelet.

As one option, the tactile sensor can be an accelerometer, a micro electromechanical sensor, a gyroscope, a capacitive sensor, a resistive sensor, and so on. The charging interface can use a micro USB connection, a type A USB connection, and so on. The network connection module may use a Bluetooth or similar, and ANT+ compatible connection, a WiFi or WiMax connection, and so on. The wearable device may also include a broad oxygen sensor, a blood sugar sensor, and so on.

Figure 1:
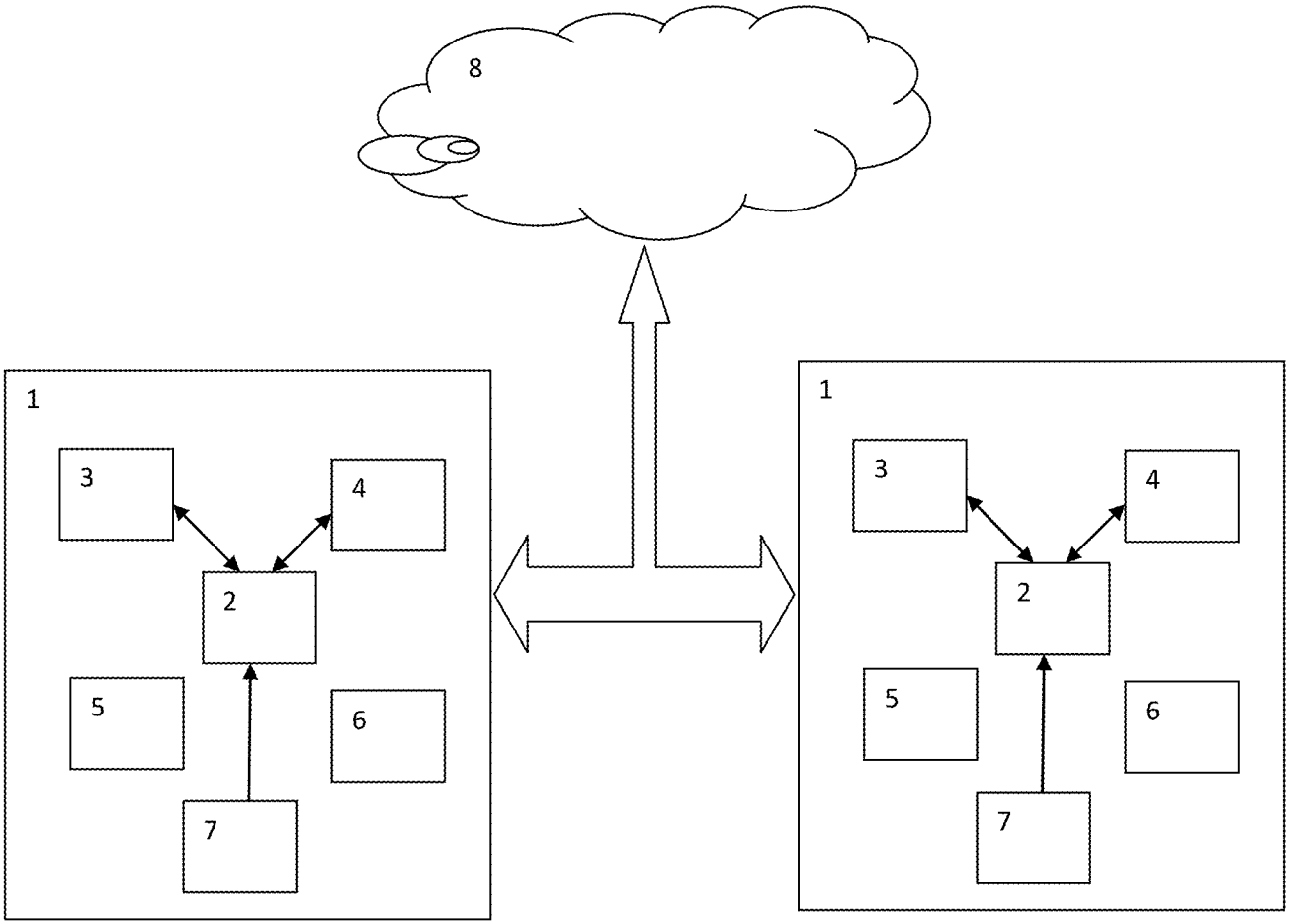
FIG. 1 illustrates two wearable devices according to the present invention, connected to a communication network.
Figure 2:
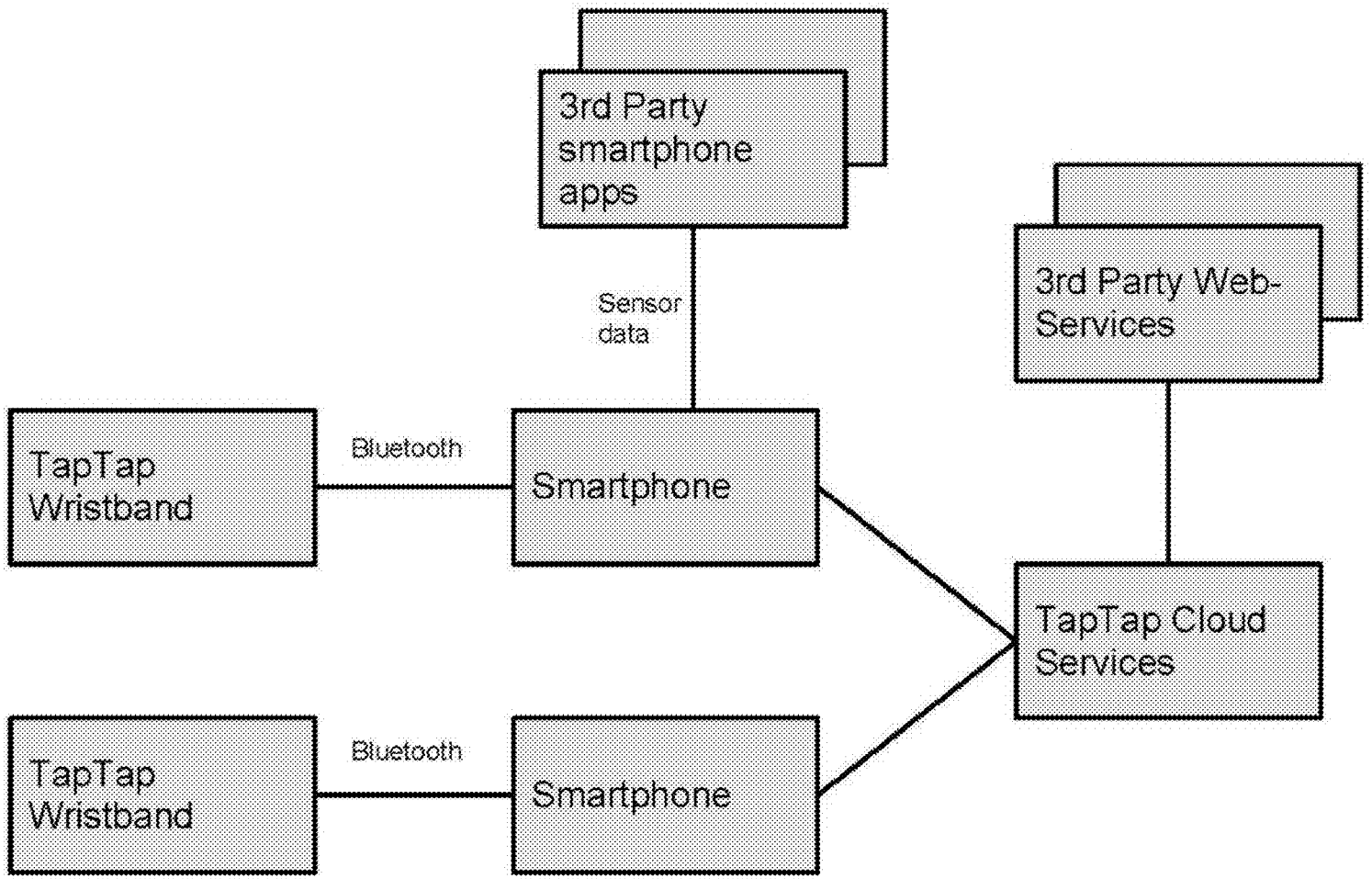
FIG. 2 illustrates two wearable devices connected to smartphones or similar, with third party smartphone applications, and also connected to cloud services.
Figure 3:
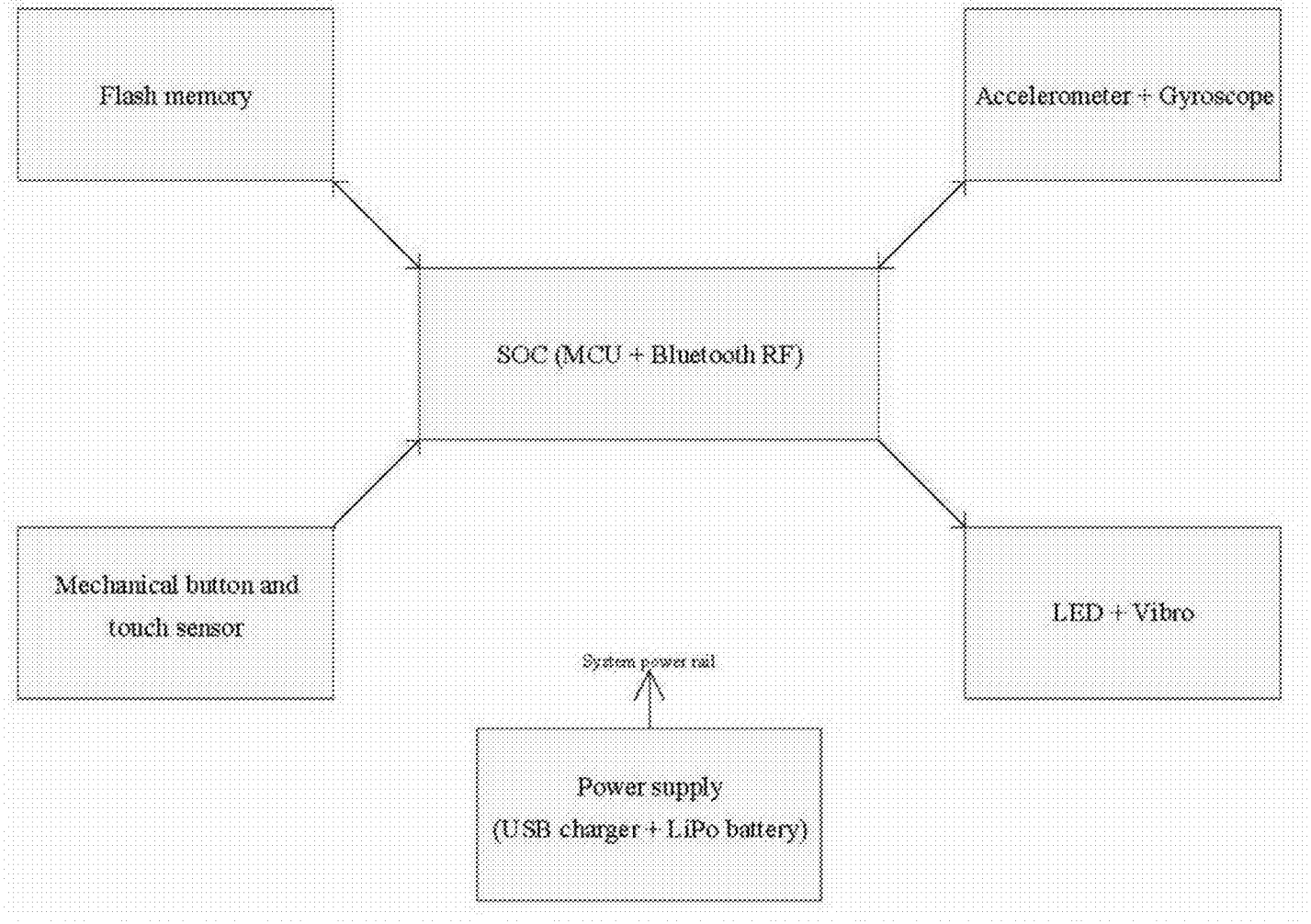
FIGS. 3 and 4 illustrate the electronic components within the electronic module.
Figure 4:
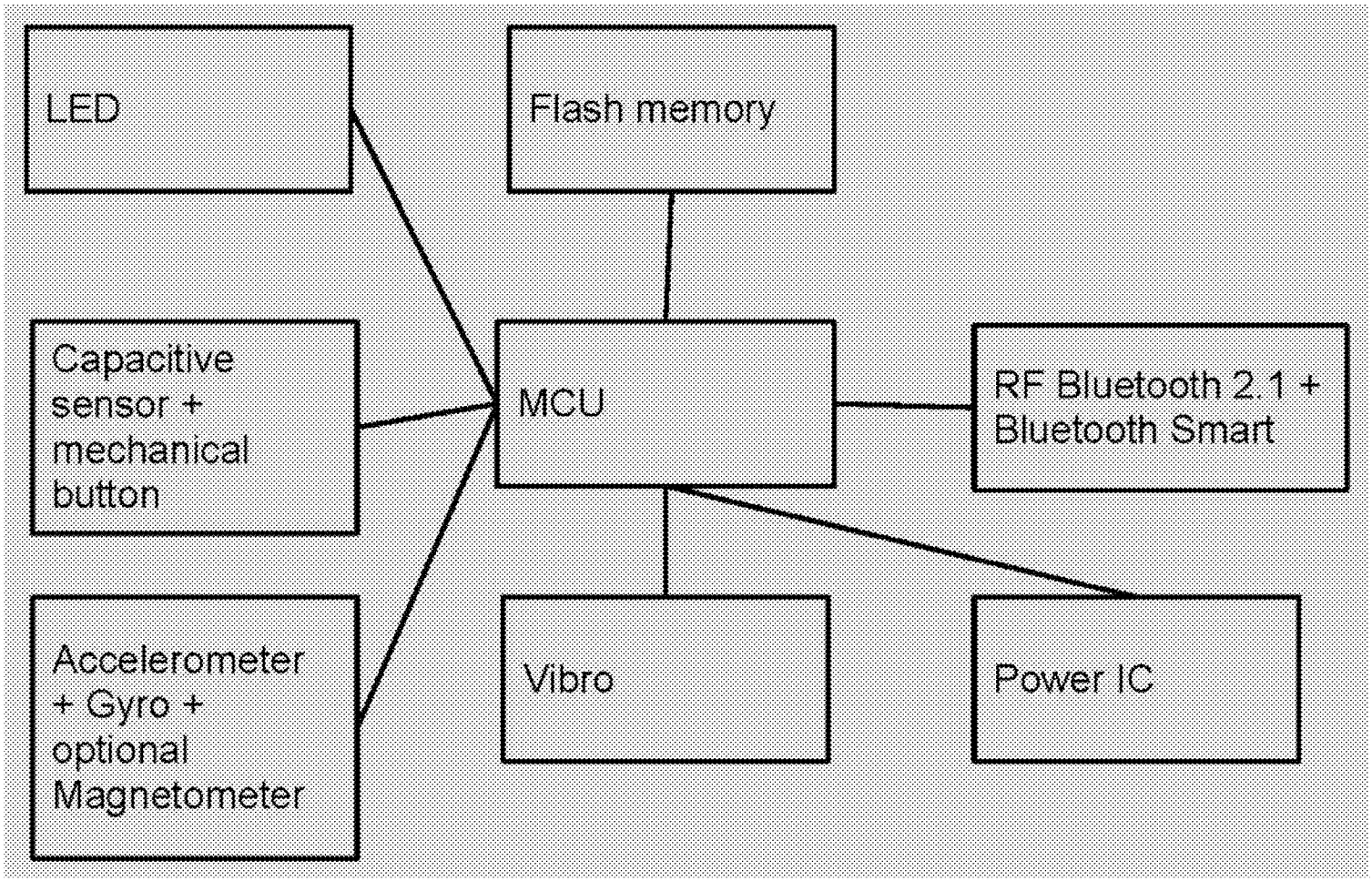
Figure 5:
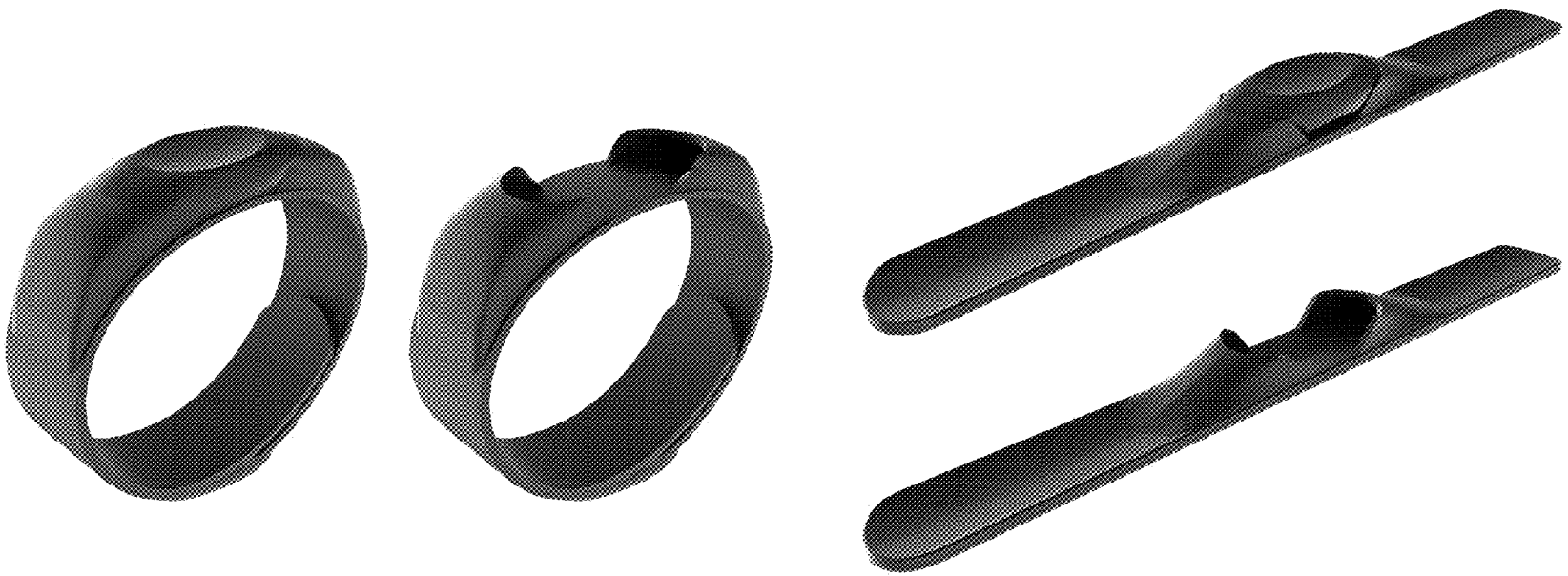
FIGS. 5, 6, 7 and 8 illustrate various two- and three-dimensional views of the bracelet and tactile/electronic component elements.
Figure 6:
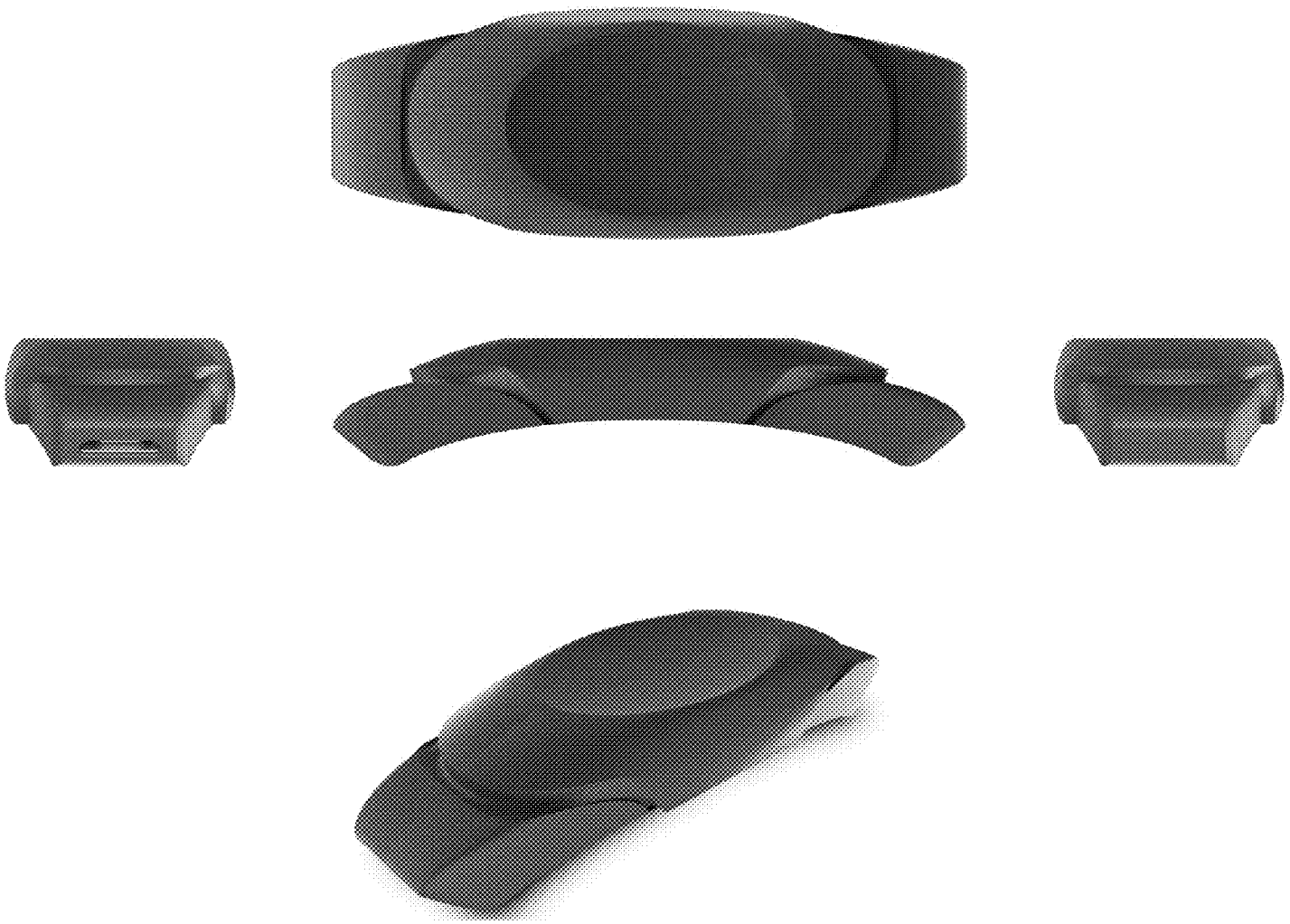
Figure 7:
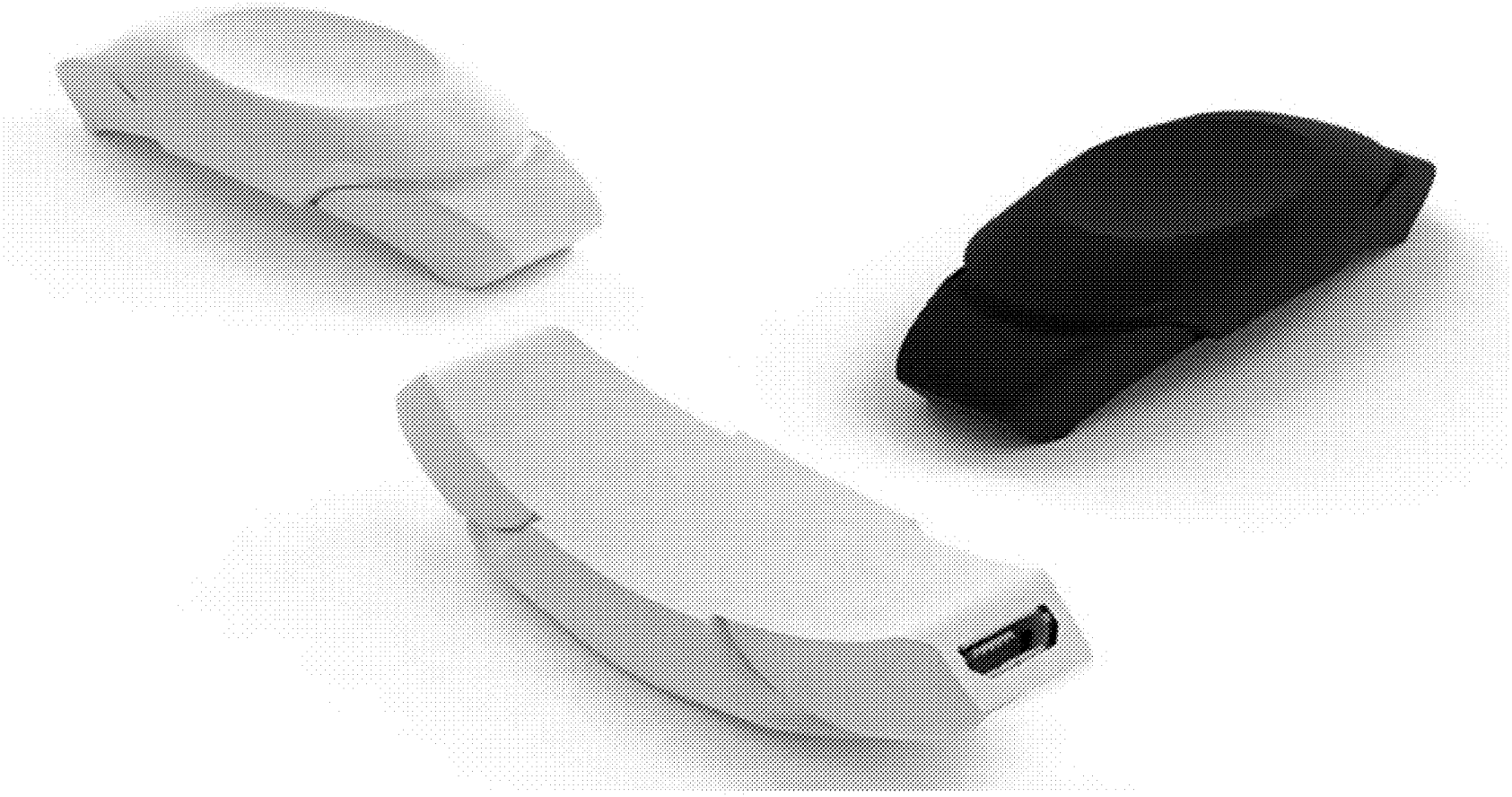
Figure 8:
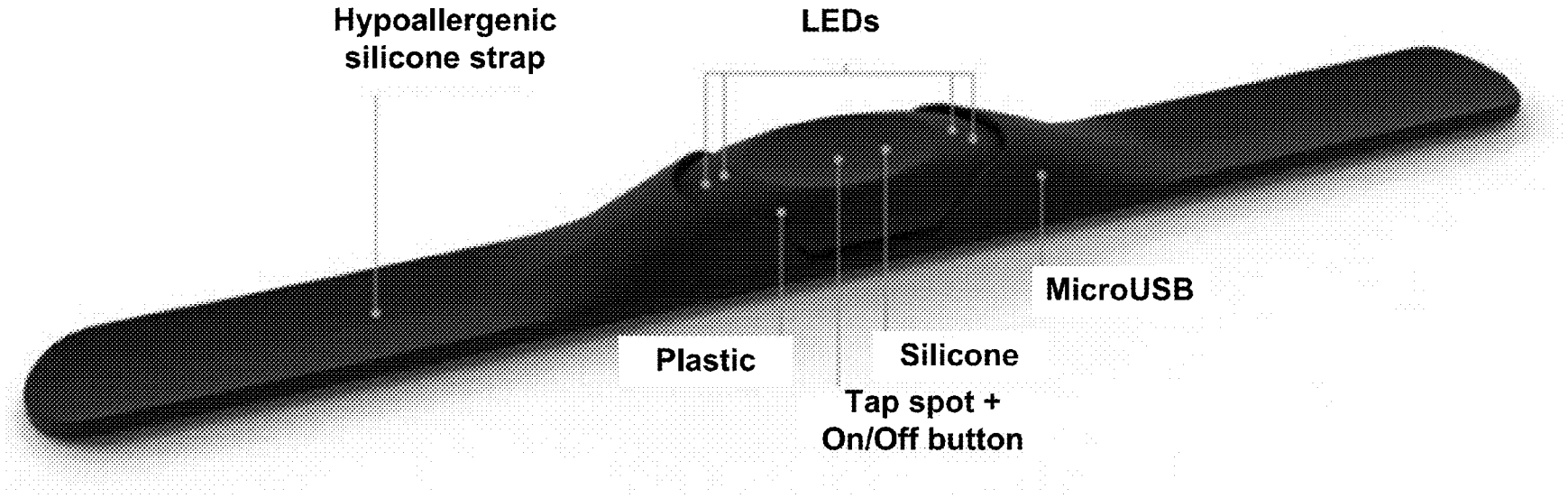
Figure 9:
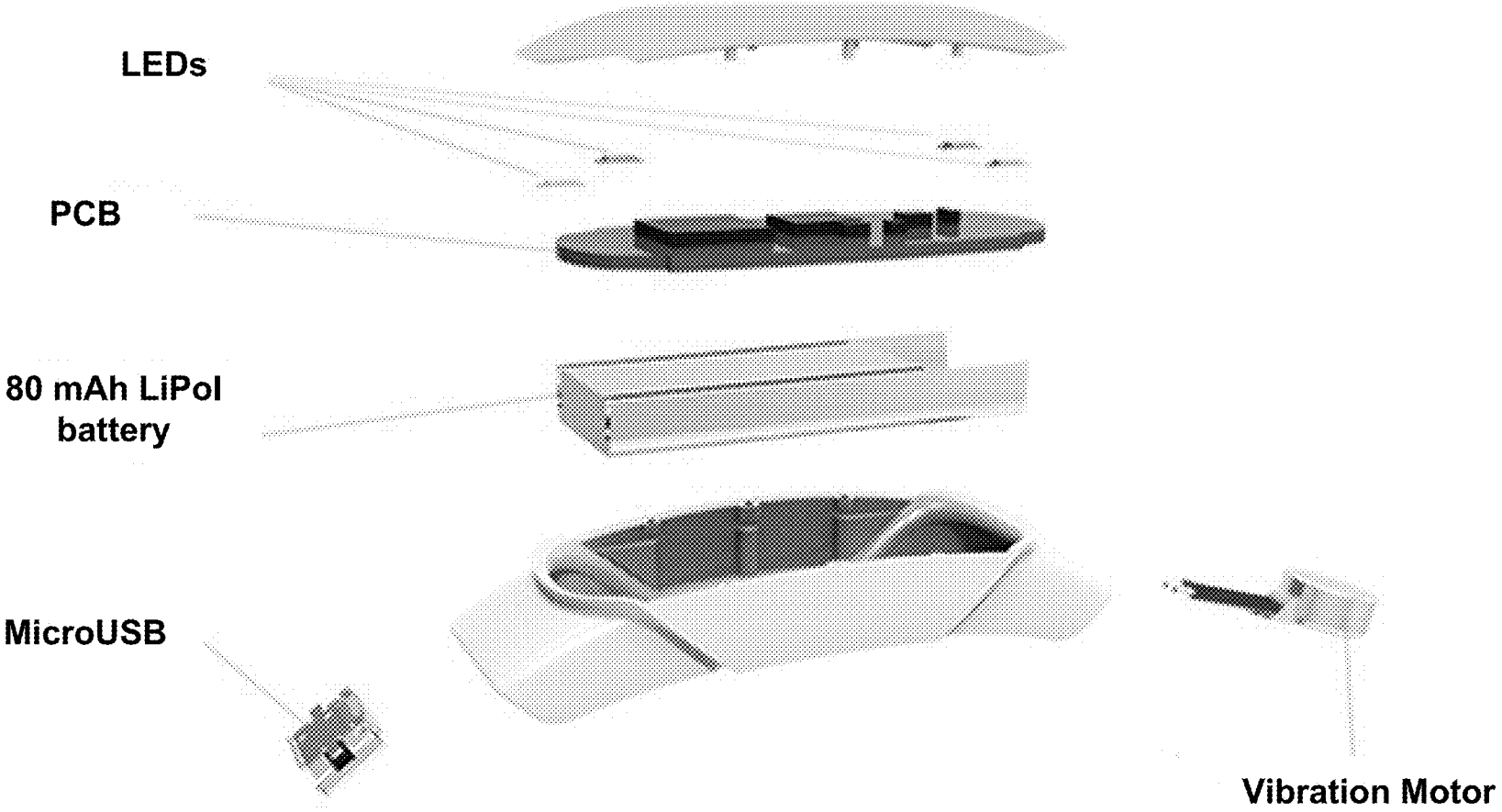
FIG. 9 illustrates the electronic component element in an exploded view, and the various components that make up the element.
Figure 10:
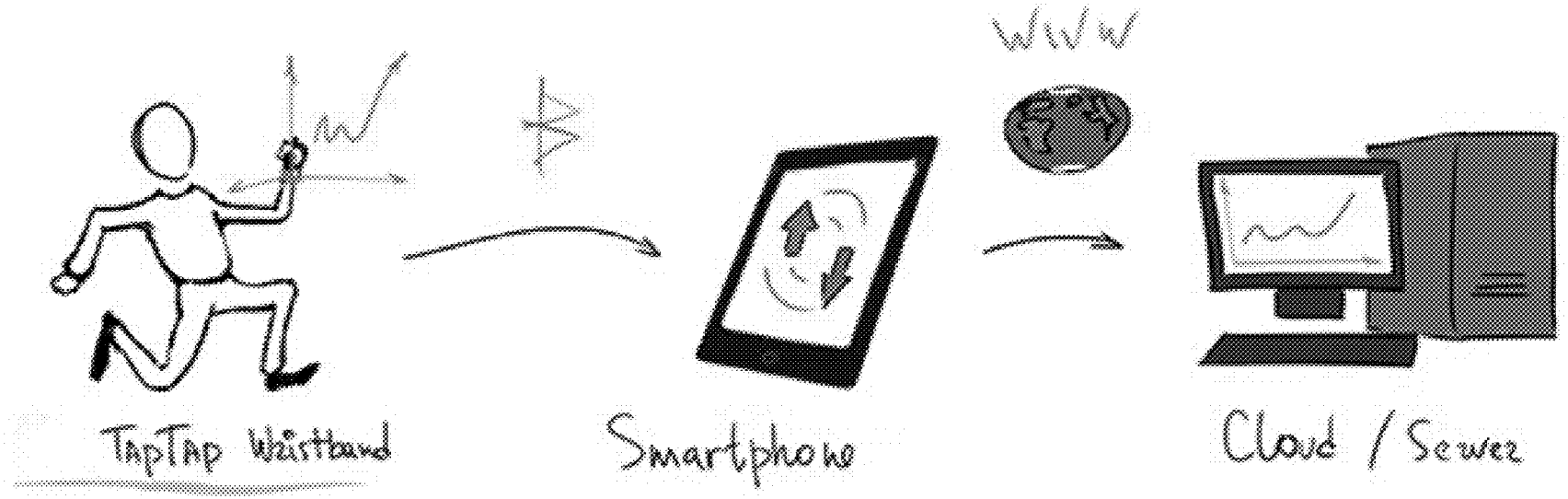
FIG. 10 illustrates how the wearable device connects to a smartphone, and then to a cloud or server.

Thus, the proposed device permits a rapid and automatic transfer of tactile event information between various such devices. FIG. 1 illustrates a system block diagram of the proposed device. As shown in FIG. 1, the wearable device 1 includes a micro controller 2. A tactile sensor 3 is connected to the micro controller 2. A device for generating tactile feedback 4 is also connected to the controller 2. A wireless network adapter 5 is connected to the micro controller 2. A control button 6 and a battery with a charging interface 7 are also connected to the micro controller 2. The tactile reproduction device element 4 can use various mechanical actuators. The wireless network connection module 5 is adapted to connect to various networks, for example, to mobile networks, local networks, local wireless networks, such as WiFi or Bluetooth enable networks, and so on. Thus, various such wearable devices 1 can be in a bidirectional two way communication between each other, either directly or through the network 8. The controller 2 can also be connected to various sensors that provide medical information about the wearer of the device, in real time.

The Wearable Device 1 Works as Follows:

Once the user turns on the wearable device 1 using the button 6, device 1 enters a search mode for similar such devices, using the wireless network module 5, as well as begins to receive information from the tactile sensor 3, and possibly other sensors connected to the micro controller 2. The wireless network connection module 5 establishes a connection with other devices, such as a smart phone or a router, or connects to the wireless network 8 directly. Then, information received in process by the controller 2 from the tactile sensor 3 and possibly other sensors is transmitted to another tactile device 1, with which the wearable device 1 is in communication. The second device 1 can reproduce the tactile events from the first device, for example, when one user taps the sensor 4 on his wearable device 1, thus, the proposed device 1 permits nearly instantaneous communication of tactile events and "feelings" between two (or more) such devices, when the devices in question are connected to the network, and do so automatically, without further intervention from the user.

As noted above, the wearable device 1 may be in a form of a bracelet, including a wristband into which the electronic-containing element is snap fitted. The bracelet can have internal reinforcement element. The bracelet may be of a single color, or multiple colors. The electronic component that is snap fitted into the bracelet can be the same color, or can be a different color. When worn, the electronic component should be close to the skin. The electronic component has a tactile sensor on top. As one option, the control button can be hidden in one or the thicker portion of the electronic component/tactile module. The electronic component module may be provided with an LED, or multiple LEDs, which can indicate Bluetooth™ connection status, charging/charged status, an indication of a received "tap" (e.g., useful when the user is not wearing the device, but left it lying on a table).

Thus, as described above, a wearable device in form of wristband for transmitting and receiving touch information permits touch transfer between two or more people. The wristband uses a low power wireless interface (such as Bluetooth™ or Bluetooth Smart™) to connect to a global network through a smartphone or any kind of gateway, and has an application core, a set of sensors for determining touches and taps—such as accelerometer, gyroscope, capacitive sensor, magnetometer or any combination of those sensors. As one example, a capacitive sensor could be implemented as single point touch sensor or as one/two axis sensor to capture touch coordinates. Resistive/Piezo touch sensors could be added to capture the pressure of touch. Vibro-motor(s), piezo motor(s) or a combination of both is used to reproduce the touch on the recipient device. Optionally, two or more vibro/piezo elements can reproduce the exact touch point. Two effects could be used to reproduce touch effect with multiple vibro/piezo elements: (a) interference of two vibrating elements with adjustable frequency, and (b) using multiple vibro-elements and reproducing touch by enabling one of them with right coordinates.

The wristband can collect raw sensor data for the applications running on the smartphone or to collect the data in the web-service, using smartphone as a gateway. The device can be implemented as monolithic wristband or as a non-flexible module with interchangeable wristband. The device can have a buffer memory to capture the sensor data and transfer it to the smartphone upon request. The device could have additional notification options such as LED or LCD. Also, device functionality could be embedded into the watches or smart watches.

The wristband has a plastic module and a hypoallergenic silicone slap-bracelet. When the bracelet is straight, the electronics module can be snap-inserted into it or pulled out. When the module is locked in, it looks like a one-piece wristband. To wear a different color, the user can pull the module away and put it in another slap bracelet.

The module is made of hard scratch- and splash-resistant plastic. The round silicone spot on top, the TapSpot, is the place where the user taps his finger on when he wants to tell his "mate" that he is thinking of them. If a particular the TapSpot is pressed a bit harder, it turns the device on and off.

Figure 11:
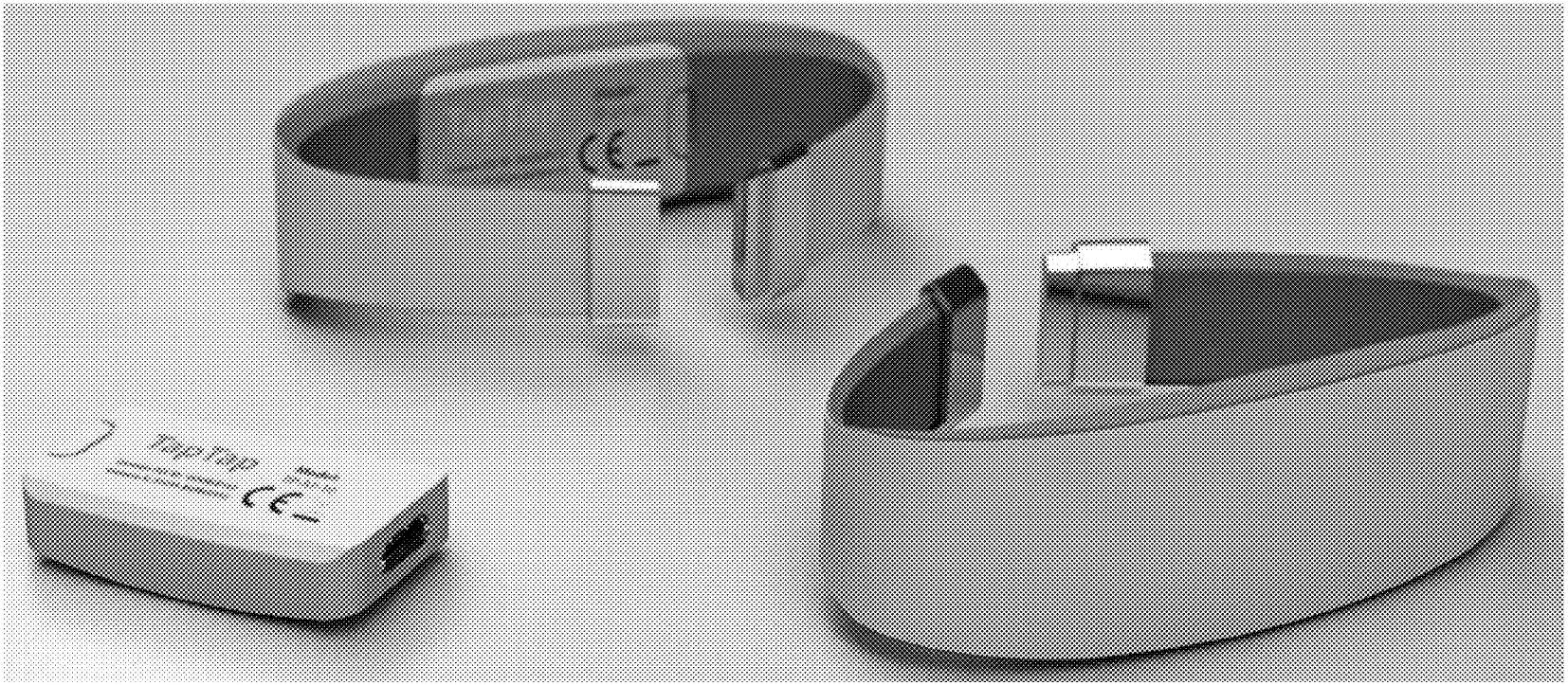
FIG. 11 illustrates another embodiment of the wearable device of the present invention.

FIG. 11 illustrates another embodiment of the wearable device of the present invention. In this embodiment, the detachable electronics module is on the inner side of the wristband. The opposite side of the wristband (i.e., the portion that would correspond to the face of a wristwatch, if the device were a watch) can have optional LEDs embedded in it, to show power status, connection status, "tap" status, and so on.

In other embodiments, the device can have the same capsule with the electronics and an interchangeable wristband. As another option, the interchangeable wristband can have a Peltier element for charging the device batteries using the temperature difference between ambient air and a human hand. Alternatively, the interchangeable wristband can have solar batteries to charge the device batteries, and/or an inductive charging antenna, to charge the device, and/or additional battery to prolong the battery lifetime As a further option, a wired or wireless data link can be placed within the wristband, and further include additional sensors placed in the wristband, such as pulse, oxydometer, a thermometer, light sensor, glucometer. As a further option, additional display devices can be integrated into the wristband or into the electronics module, such as, a watch/time display, a dot-matrix display (LCD, OLED, AMOLED, eINK, and so on.

As a further option, the wristband can changes its color/texture by a command from the electronics module, using bi-stable or low-power displays, such as eINK, LivingSkin from Kent Technologies and so on.

As a further option, the electronics capsule can include an inductive charging device, and/or a glucometer, a thermometer, a pulse sensor and other types of sensors. The sensor(s) can be placed on the bottom surface of the capsule, which will allow easy-to-manufacture different capsule versions with different sensors sets. A wire (spring) connector type between main PCB in the electronics module and bottom sensors surface can be used. Such a device can provide the raw data of the sensors to a smartphone or remote server, and is also capable of running algorithms to provide event-generated data/obstructed data, to save the power with wireless transmission and/or to provide a more flexible API for third party application developers. As a further option, the stored data can be overwritten (in a closed loop) when buffer memory is full. As a further option, the capsule/electronics module can be used not only with wristband, but with any kind of holder that sticks or attaches to the clothes or armband.

As a further option, the device can detect environmental conditions, using its sensors to save the battery power or change the notification parameters. For example, if the device is stationary on a table or similar surface, this can be detected by an accelerometer, and the vibration motor and/or gyroscope are switched (if enabled previously), while light notifications are enabled. For example, for missed taps, the device provides an API for its sensors and notification methods (light, vibro).

As a further option, the capsule can have a dot-matrix, LCD, LED, AMOLED display or single elements. As a further option, the capsule can have a capacitive sensor to detect the touches or user's hand proximity. As a further option, the capsule or wristband can have an NFC tag to make a Bluetooth pairing procedure easier and faster. As a further option, the device can use vibration/light patterns and display to help the user determine the taps sent from another device vs. notifications send by third party applications. The device can also use vibration/light and display to identify the touch signal sources, when more than two devices are used within one group. The device can detect taps/touches patterns to select the recipient when more than two devices are used within one group. The device can use vibration/light and display to inform the user of unavailability of the recipient or about the connection issues (Internet, Bluetooth, LAN, etc.).

The touch replay options can be enabled using any number of mechanisms. For example, a single vibrating motor with variable speed (speed-force tradeoff). Alternatively, multiple vibrating elements can be used (additional vibration elements can be installed in the capsule or in the wristband). As a further alternative, the vibration elements can use low frequency interference with a computed peak value at the exact point between two oscillators, to reproduce the touch at the exact point.

As a further option, single or multiple piezo elements can be used for reproducing the touch. This can include a single piezo element, a linear piezo element/array, or a 2D piezo array.

The touch capture options can also use an accelerometer and/or a gyroscope, particularly for tap recognition and for tap force recognition. A capacitive sensor can also be used, which can be placed in the capsule or in the wristband)

A combination of capacitive sensor and an accelerometer can be used for touch recognition, including touch force recognition by using an accelerometer. As a further option, a gyroscope can be used for fine tap recognition in case of high amplitude movement (like running, walking, driving). A piezoelectric sensor can also be used for tap and tap force recognition.

Gesture recognition can also be accomplished in a number of ways. On the wristband side, in order to minimize the data transfer between the wristband and the phone, a trigger signal for smartphone side applications can be, for example (a) make a gesture to turn on the lights, (b) make a gesture to drop the incoming call, (c) make a gesture to send the sms with user location. Gesture recognition algorithms could be preloaded at the factory and updated later via Bluetooth® from a smartphone application. On the phone side, this enables complex gesture recognition with high computing power, as well as realtime use by applications such as games, activity trackers, and so on.

As a further option, data collection could be accomplished when an application on the smartphone requests sensor data collected by the wristband. This can be done either as a real time data transfer, or using a buffer memory on the wristband side, for example, either until the memory buffer is full, or until the data is requested by the application with a closed loop buffer. The data request can include sensor types, sensor data frequency, and/or recording type: limited time, infinite loop with overwriting on the wristband, on the wristband with memory full trigger for the smartphone application, with realtime data transfer to the smartphone application Optionally, physical two way data channel between a capsule and a wristband to extend the functionality of the wristband and the capsule. For example, wristband electronics could use capsule to communicate with the smartphone or capsule logic. This can include a wristband with LED/eINK/LCD display, a wristband with LED lighting, and/or a wristband with additional sensors or/and touch replay devices.

Optional power connection can exist between the capsule and the wristband, in order to charge/power wristband batteries from the capsule, or charge/power capsule batteries from the wristband, or charge capsule with external charger and a connector placed on the wristband.

As a further option, integration with external services, such as IFTTT (ifttt.com) can be implemented. One option is to use gestures with the bracelets as a trigger for an action by the service. The action can be an SMS to a pre-defined recipient, containing current location of the sender, turning on the light using smart lighting, such as Belkin WeMo switch. The external trigger for ifttt can be a specific vibration mode or LED activation, e.g., three taps with specific frequency against a table. Other services, such as runkeeper, can be integrated with through the webservice, and do not need application support on the smartphone. At the same, the application on the smartphone can collect data from the device sensors (possibly in real time) in its own buffer, to minimize energy consumption of the device. As a further option, the device can be used as an interface for a game device or for a game on a smartphone or tablet (e.g., to use instead of, or in addition to, buttons and sensors on the smartphone). It should also be appreciated that various modifications, adaptations, and alternative embodiments thereof may be made within the scope and spirit of the present invention. The invention is further defined by the following claims.

Having thus described the different embodiments of a system and method, it should be apparent to those skilled in the art that certain advantages of the described method and apparatus have been achieved.

What is claimed is:

1. A wearable electronic device comprising:

a wristband;

a detachable electronic module adapted to fit into the wristband, the module including a controller, a control button, a tactile sensor that uses a combination of a capacitive sensor and an accelerometer, a wireless interface adapter, and a tactile event reproduction element, all connected to the controller that determines, based on signals from the combination, whether the device is stationary on a flat surface, and whether a user's hand is in proximity to the device, wherein the module is configured to transmit a touch or a tap on the tactile sensor to a second wearable device through the wireless interface adapter, including selecting of a tap or touch pattern to be transmitted depending on which wearable device, out of a group of wearable devices, is selected by the user as a recipient, including recognition of tap force for transmission to the second wearable device and accurate reproduction on the second wearable device, and including informing the user of the device of unavailability of the second wearable device, and wherein the module is configured to receive a notification of a tactile event on the second wearable device through the wireless interface adapter and to reproduce the tactile event using the reproduction element.

2. The device of claim 1, wherein the tactile sensor includes a MEMS.

3. The device of claim 1, wherein the tactile sensor includes a gyroscope.

4. The device of claim 1, wherein the tactile sensor includes a resistive sensor.

5. The device of claim 1, further comprising a charging interface and a battery.

6. The device of claim 5, wherein the charging interface uses a micro USB connector.

7. The device of claim 5, wherein the charging interface uses a USB Type A connector.

8. The device of claim 1, wherein the network adapter is a Bluetooth adapter.

9. The device of claim 1, wherein the network adapter is an ANT+ standard-enabled.

10. The device of claim 1, wherein the network adapter connects to a smartphone or a tablet.

11. The device of claim 1, wherein the network adapter connects to the second device over the Internet via a server.

12. The device of claim 1, wherein the module includes a blood oxygen sensor connected to the controller.

13. The device of claim 1, wherein the module includes a blood sugar sensor connected to the controller.

14. The device of claim 1, wherein the reproduction element is a vibro motor.

15. The device of claim 1, wherein the reproduction element is a piezo motor.

16. A wearable electronic device comprising:

a wristband having a battery within;

a detachable electronic module adapted to fit into the wristband, the module including a controller, and a control button, a tactile sensor that uses a combination of a capacitive sensor and an accelerometer, a wireless interface adapter, and a tactile event reproduction element, all connected to the controller that determines, based on signals from the combination, whether the device is stationary on a flat surface, and whether a user's hand is in proximity to the device, wherein the module is configured to transmit a touch or a tap on the tactile to a second wearable device through the wireless interface adapter, including selecting of a tap or touch pattern to be transmitted depending on which wearable device, out of a group of wearable devices, is selected by the user as a recipient, including recognition of tap force for transmission to the second wearable device and accurate reproduction on the second wearable device, and including informing the user of the device of unavailability of the second wearable device, and wherein the module is configured to receive a notification of a tactile event on the second wearable device through the wireless interface adapter and to reproduce the tactile event using two vibrating elements configured to vibrate at different frequencies.

17. A wearable electronic device comprising:

a detachable electronic module adapted to fit into the wristband, the module including a controller, and a control button, a tactile sensor that uses a combination of a capacitive sensor and an accelerometer, a wireless interface adapter, and a tactile event reproduction element, all connected to the controller that determines, based on signals from the combination, whether the device is stationary on a flat surface, and whether a user's hand is in proximity to the device, wherein the module is located on an inner side of the wristband facing the user's wrist, wherein the module is configured to transmit a touch or a tap on the tactile to a second wearable device through the wireless interface adapter, including selecting of a tap or touch pattern to be transmitted depending on which wearable device, out of a group of wearable devices, is selected by the user as a recipient, including recognition of tap force for transmission to the second wearable device and accurate reproduction on the second wearable device, and including informing the user of the device of unavailability of the second wearable device, and wherein the module is configured to receive a notification of a tactile event on the second wearable device through the wireless interface adapter and to reproduce the tactile event using two vibrating elements configured to vibrate at different frequencies; and at least one LED on an outer side of the wristband connected to the controller and configured to indicate received signals from the second wearable device.

18. The device of claim 1, wherein the wristband collects data and transmits it to an application on a mobile phone.

* * * * *